US007375477B2

(12) United States Patent
Hsieh et al.

(10) Patent No.: US 7,375,477 B2
(45) Date of Patent: May 20, 2008

(54) COLD CATHODE FLUORESCENT LAMP DRIVING SYSTEM

(75) Inventors: Kuan-Hong Hsieh, Tu-Cheng (TW); Shin-Hong Chung, Tu-Cheng (TW); Wei-De Bao, Shenzhen (CN)

(73) Assignees: Hong Fu Jin Precision Industry (Shenzhen) Co., Ltd., Bao-an District, Shenzhen, Guangdong Province (CN); Hon Hai Precision Industry Co., Ltd., Tu-Chen, Taipei Hsien (TW)

( * ) Notice: Subject to any disclaimer, the term of this patent is extended or adjusted under 35 U.S.C. 154(b) by 298 days.

(21) Appl. No.: 11/168,067

(22) Filed: Jun. 28, 2005

(65) Prior Publication Data

US 2006/0017408 A1 Jan. 26, 2006

(30) Foreign Application Priority Data

Jul. 21, 2004 (CN) ..... 2004 1 0050822

(51) Int. Cl.
*H05B 37/00* (2006.01)

(52) U.S. Cl. ..... 315/312; 315/291; 315/307

(58) Field of Classification Search ..... None
See application file for complete search history.

(56) References Cited

U.S. PATENT DOCUMENTS

| | | | | |
|---|---|---|---|---|
| 6,104,146 | A | 8/2000 | Chou et al. | 315/277 |
| 6,498,437 | B1 * | 12/2002 | Chang et al. | 315/141 |
| 6,979,959 | B2 * | 12/2005 | Henry | 315/291 |
| 7,208,886 | B2 * | 4/2007 | Hsieh et al. | 315/291 |
| 2004/0183465 | A1 * | 9/2004 | Jang | 315/224 |
| 2005/0093476 | A1 * | 5/2005 | Gray | 315/224 |
| 2005/0253537 | A1 * | 11/2005 | Jang et al. | 315/307 |

* cited by examiner

*Primary Examiner*—Trinh Vo Dinh
(74) *Attorney, Agent, or Firm*—Morris Manning Martin LLP; Tim Tingkang Xia, Esq.

(57) ABSTRACT

A CCFL (cold-cathode fluorescent lamp) driving system for multiple CCFL loads includes a transformer, a CCFL circuit, and a controlling circuit coupled between the transformer and the CCFL circuit. The CCFL circuit includes multiple CCFL loads. The transformer includes a primary winding and a secondary winding, with the primary winding coupled to a voltage source and the secondary winding coupled to the CCFL loads. The controlling circuit includes a part for generating a predetermined voltage signal to power the CCFL loads during a warm-up stage and another part for generating a modulation signal. With such circuit arrangement, each of the multiple CCFL loads is powered from an off state to an operationally-on state.

7 Claims, 3 Drawing Sheets

COLD CATHODE FLUORESCENT LAMP DRIVING SYSTEM

BACKGROUND OF THE INVENTION

1. Field of the Invention

The present invention relates to cold cathode fluorescent lamp (CCFL) driving systems for CCFL loads, and particularly to a driving system that powers on multiple CCFL loads from an off state to an operationally-on state.

2. General Background

Fluorescent lamps are typically used in a number of applications where artificial light is required but the power required to generate the light is limited. One such application is the backlighting for a notebook computer or similar portable electronic device. One popular type of fluorescent lamp is the cold cathode fluorescent lamp (CCFL), which is almost universally used in the panels of various LCDs (liquid crystal displays). The CCFL requires a high starting voltage (on the order of 700-1,600 volts) for a short period of time, to ionize the gas contained within the lamp tube and thereby ignite the lamp. After the gas in the CCFL is ionized and the lamp is lit, less voltage is needed to keep the lamp on.

CCFL tubes typically contain a gas, such as argon, xenon or the like, along with a small amount of mercury. After an initial ignition stage and the formation of plasma, electrical current flows through the tube, which results in the generation of ultraviolet light. The ultraviolet light in turn irradiates a phosphoric material coated on the inner wall of the tube, resulting in the emission of visible light. This process is achieved by the application of a driving system that can be utilized to generate an AC voltage to drive the CCFL load when a DC voltage is initially applied.

FIG. 3 shows a conventional CCFL driving system 10. The system 10 broadly includes a power supply 12, a CCFL driving circuit 14, a feedback loop 16, a controller 18, and a CCFL circuit 15. The feedback loop 16 includes sense impedance, such as a sense resistor Rs. The sense resistor Rs is configured for sensing the current $I_{out}$ flowing through the CCFL loads included in the CCFL circuit 15, and further provides a feedback signal $V_{FB}$ as input to the controller 18. The CCFL driving circuit 14 is supplied a DC voltage $V_{cc}$ by the power supply 12 and is controlled by the controller 18, and thus generates the AC voltage $V_{out}$ applied to the CCFL loads. The controller 18 is further adapted to receive the feedback signal $V_{FB}$ from the feedback loop 16 so as to allow for the controller 18, through the CCFL driving circuit 14, to control the power delivered to the CCFL load. The CCFL driving circuit 14 generally includes a self-oscillating DC to AC converter, known as a Royer circuit, which commonly includes a single transformer 140 as shown in FIG. 3. Therefore, the DC voltage from the power supply 12 is converted into the AC voltage by the transformer 140, so that the AC voltage is provided to drive the CCFL loads included in the system 10.

One of the problems with the circuit shown in FIG. 3 is that one CCFL lamp may be ignited while the other one is still dormant. That is, not all of the lamps may be completely ignited. For example, since the sense resistor Rs merely senses the overall output current Iout, the CCFL driving system 10 may not detect the dormant CCFL lamp, and may continue to run normally. However, if either of the CCFL lamps is not ignited (i.e., stays dormant), the lighting of the entire large panel may be significantly affected. Furthermore, the dormant lamp may degrade the expected working lifetime of the other lamp, because each of the lamps bears much more current than previously. This is particularly so if either of the lamps is dormant on repeated occasions.

A so-called soft start mode is applicable to some CCFL driving systems disclosed in various articles and issued patents, such as, for example, in U.S. Pat. No. 6,501,234. The soft start mode applies to one CCFL load only, and is utilized to enable the CCFL load to be powered from an off state to an operationally-on state. The soft start mode has not been adapted to a system having a plurality of CCFLs, whereby each of the CCFLs can be completely ignited when the system is initially powered up.

What is needed, therefore, is a CCFL driving system which can be utilized to assure that each of CCFL loads included therein is powered from an off state to an operationally-on state.

SUMMARY

A CCFL driving system for multiple CCFL loads is provided herein. The CCFL driving system generally includes a transformer and a controlling circuit coupled thereto. The transformer includes a primary winding and a secondary winding, with the primary winding coupled to a voltage source and the secondary winding coupled to a CCFL (cold-cathode fluorescent lamp) circuit. The CCFL circuit generally includes multiple CCFL loads therein. The controlling circuit is coupled between the primary winding and the secondary winding and generate a predetermined voltage signal to power each of the multiple CCFL loads from an off state to an operationally-on state during a warm-up stage. The controlling circuit can also generate a pulse or pulse-like signal(s) that maintains the multiple CCFL loads in the operationally-on state during an operationally-on stage after the warm-up stage. In one exemplary embodiment, the controlling circuit further includes a capacitor configured for generating such a predetermined voltage signal to power each of the multiple CCFL loads from the off state to the operationally-on state, wherein the capacitor has a capacitance determined according to the number of the CCFL loads. In another exemplary embodiment, the CCFL driving system further includes a determining circuit, coupled to the controlling circuit, for determining when to trigger the transition from the warm-up stage to the operationally-on stage. In another exemplary embodiment, the determining circuit includes a comparator configured for comparing a sense current flowing through the multiple CCFL loads with a reference current, and for switching from the warm-up stage to the operationally-on stage when the sense current is equal to the reference current.

Other advantages and novel features will become more apparent from the following detailed description when taken in conjunction with the accompanying drawings, in which:

DETAILED DESCRIPTION OF THE PREFERRED EMBODIMENTS

The CCFL driving system described hereinbelow is adaptable for multiple cold cathode fluorescent lamps (CCFLs). The CCFLs are arranged, for example, on a large panel or panels with a minimum of 6 in a group. There may also be other suitable arrangements for the CCFLs in various applications. The following description is of a driving system with only four lamps, for the purposes of exemplary illustration of embodiments of the present invention. The embodiments of the present invention are not to be limited by the number of loads, nor are they to be limited to CCFL loads or any other particular type of load.

Figure 1:
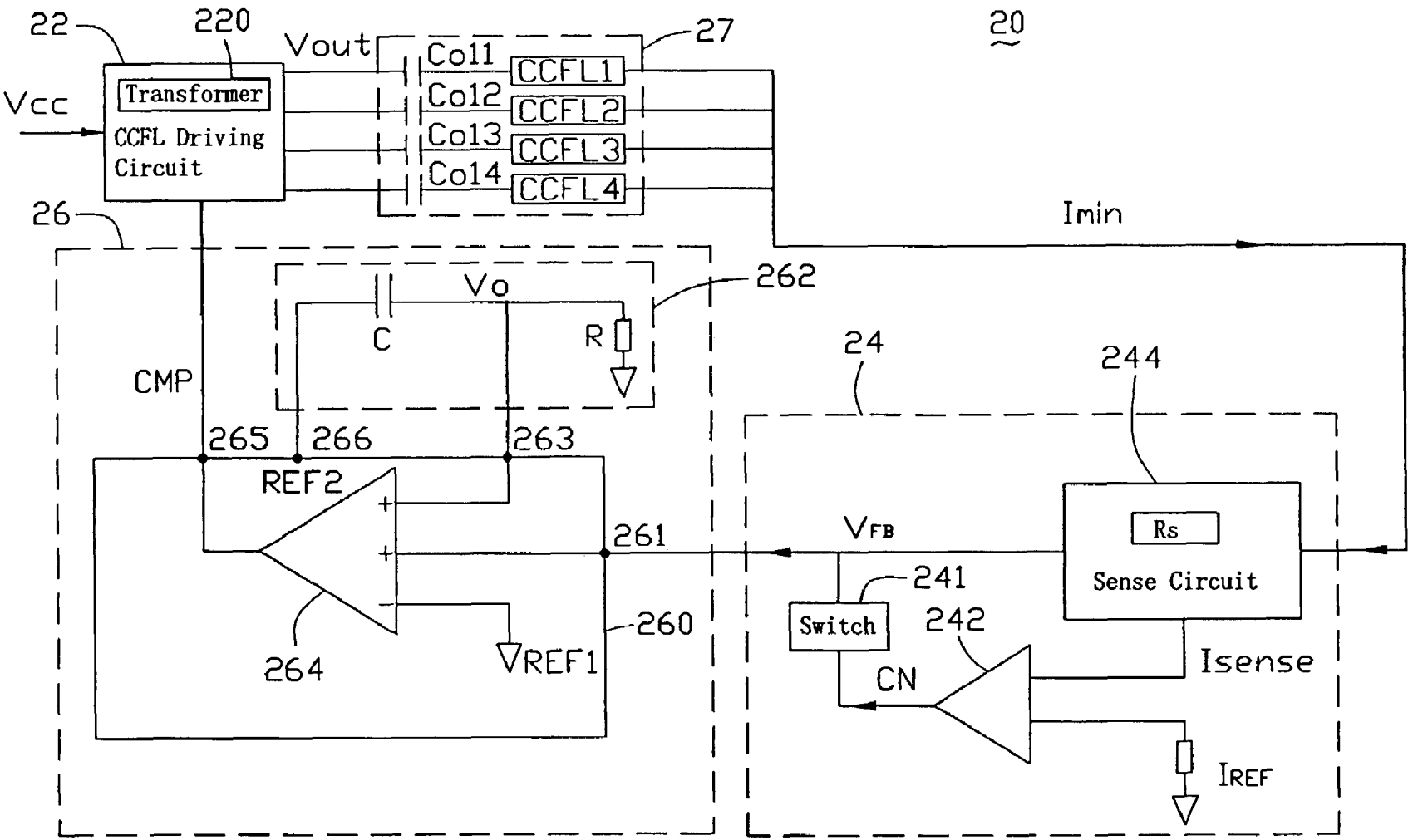
FIG. 1 is a circuit diagram of a CCFL driving system according to a preferred embodiment of the present invention.
Figure 2:
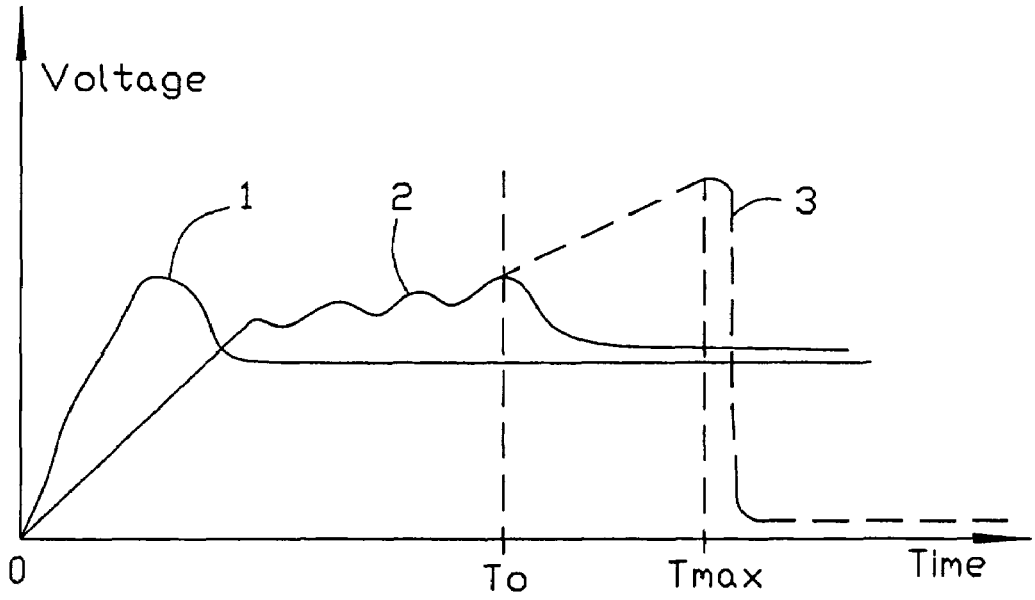
FIG. 2 is a graph of voltage versus elapsed time, showing plots of signals in respect of the CCFL driving system of FIG. 1 and in respect of the CCFL driving system of FIG. 3.

Referring to FIGS. 1 and 2, a CCFL driving system 20 for four CCFL loads according to a preferred embodiment of the present invention is shown. As a general overview, the present CCFL driving system 20 is operable to generate a predetermined voltage (shown in FIG. 2 as a voltage curve 2) during a warm-up stage, and then generate an appropriate pulse or pulse-like signal(s) to regulate the power to be delivered to CCFL loads during an operationally-on stage. The warm-up stage typically precedes the operationally-on stage. Further, during the warm-up stage, each of the CCFL loads is required to be powered from an off state to an operationally-on state. During the operationally-on stage, all of the CCFL loads are to be maintained in an operationally-on state, which is described in greater detail below.

The CCFL driving system 20 generally includes a CCFL driving circuit 22, a feedback circuit 24, a controlling circuit 26, and a CCFL circuit 27. Each of these functional components is described in detail below.

The CCFL driving circuit 22 can be any suitable circuit configuration for providing an AC voltage to the CCFL circuit 27 under the control of the controlling circuit 26 when a DC voltage from a voltage source (not shown) is applied to the CCFL driving circuit 22. The CCFL driving circuit 22 generally includes a self-oscillating DC to AC converter, known as a Royer circuit. In the exemplary embodiment shown in FIG. 1, the CCFL driving circuit 22 includes a single transformer 220 having a primary winding and a secondary winding. The DC power source (not shown) is coupled to the primary winding of the transformer 220, and the CCFL circuit 27 is coupled to the secondary winding of the transformer 220. Thus, the DC voltage from the power source at the primary winding of the transformer 220 is converted into an AC voltage. The AC voltage is then applied to the CCFL circuit 27 via the secondary winding of the transformer 220. However, in other applications, any suitable transformer or transformers may be used. For example, any or all of such one or more transformers may comprise a greater number of turns of the windings and/or stronger cores, in order to carry out the purposes of the present invention. In such applications, the transformer or transformers may be adapted for more than four CCFL loads (not shown). If more transformers are employed, the overall cost of the CCFL driving system 20 is increased.

In FIG. 1, the CCFL circuit 27 is shown to include four CCFL loads therein. However, any suitable number of CCFL loads or other types of loads can be employed for practicing the present invention, which is not to be construed as being limited to the configuration shown in FIG. 1. Ideally, each of the CCFL loads is identical, so that current is evenly divided between CCFL1, CCFL2, CCFL3 and CCFL4. In the present embodiment, for example, where any unbalanced condition may exist in any individual CCFL loop, the impedances Co11, Co12, Co13 and Co14 can be provided to couple the loads, CCFL1, CCFL2, CCFL3 and CCFL4 respectively, if variations among those CCFLs exist and greatly influence the current drawn for each CCFL. The respective values of the impedances Co11, Co12, Co13 and Co14 can be adjusted according to the corresponding load coupled thereto, so that current is evenly divided between CCFL1, CCFL2, CCFL3 and CCFL4. However, any other suitable method to prevent unbalanced conditions between the CCFLs can be employed herein. For example, reference is made to U.S. Pat. No. 6,104,146 issued to Chou and entitled "Balanced power supply circuit for multiple cold-cathode fluorescent lamps". This patent is incorporated herein by reference. It is assumed herein that the current drawn for the respective CCFL loads is substantially equal. Then the CCFL circuit 27 generates an output current as $I_{min}$. The current $I_{min}$ is a minimum current that is necessary to ignite a selected number of CCFL loads (i.e., more than one CCFL loads), or all of the CCFL loads when the CCFL loads are initially powered up. In the present embodiment of FIG. 1, the current $I_{min}$ is used to ignite a predetermined number of CCFL loads, such as all four CCFL loads.

The feedback circuit 24 can include any suitable circuit configuration for generating a feedback signal as an input to the controlling circuit 26, and for regulation of the current delivered to the CCFL circuit 27. In the exemplary embodiment, the feedback circuit 24 generally includes a sense circuit 244 and a second comparator 242. The sense circuit 244 is shown to include a sense impedance, for example a resistor Rs, for sensing the current flowing from the CCFL circuit 27. Such current is hereinafter referred to as "a feedback current $I_{sense}$". Thus, a feedback voltage $V_{FB}$ is generated through the resistor Rs, which is described further hereinbelow. In one exemplary embodiment, the current $I_{sense}$ is referable to the overall current drawn from all of the CCFL loads included in the CCFL circuit 27. In other exemplary embodiments, the current $I_{sense}$ may be referable to the current from a predetermined number of CCFL loads in the CCFL circuit 27, in each case according to a desired application thereto. For example, certain applications may require that the current of a predetermined number of CCFL loads or a selected group of CCFL loads be detected. The second comparator 242 is provided to compare the sense current $I_{sense}$ with a reference current $I_{REF}$, and generate an appropriate first control signal CN based on a difference therebetween. In the present embodiment, the reference current $I_{REF}$ is assumed to be a predetermined constant reference current, for example three-quarters of the current $I_{min}$. The reference current $I_{REF}$ can alternatively be any suitable constant or variable reference value, according to other embodiments of the present invention. For example, if a number 'n' of CCFL loads is included in the CCFL circuit 27, the reference current $I_{REF}$ may be calculated according to the expression $(n-1)/n\ I_{min}$ where n is equal to or greater than 2.

In the embodiment shown in FIG. 1, if the sense current $I_{sense}$ received is equal to or greater than ¾ of $I_{min}$, this is considered to be indicative of complete ignition of each of the four CCFL lamps. Accordingly, the second comparator 242 generates an appropriate signal, for example a logic state "0," and sends the signal to the controlling circuit 26. Conversely, if $I_{sense}$ is less than ¾ of $I_{min}$, another corresponding signal such as a logic state "1" is generated. When this occurs, it means not all of the CCFL lamps have been ignited within a predetermined time. That is, the current $I_{sense}$ has not reached the predetermined value of ¾ $I_{min}$ that is necessary to ignite all four of the CCFLs. This situation may arise, for example, where one or more of the CCFLs are already damaged. As shown in FIG. 1, the first control signal CN is used to have the feedback voltage $V_{FB}$ controllably fed into the controlling circuit 26 for further processing, which is described in more detail below. Preferably, in the present embodiment, a switch or switches 241, such as a transistor or a series of transistors, is/are provided to electrically connect the second comparator 242 with the controlling circuit 26 to perform such a controlling operation. In the illustrated embodiment, there is only one switch 241. That is, the switch 241 responds to the first control signal CN, so that under the control of the switch 241 the feedback voltage $V_{FB}$ can be fed into the controlling circuit 26. In other exemplary embodiments (not shown herein), the feedback voltage $V_{FB}$ together with the first control signal CN may be fed into the controlling circuit 26, to generate another appropriate signal desired to carry out the purposes of the present invention. For example, the feedback voltage $V_{FB}$ may be modified or changed to another defined voltage in the controlling circuit 26.

Additionally, in other embodiments, a protection circuit (not shown) can be provided, which may be electrically connected to the feedback circuit 24. Such a protection circuit is typically designed to calculate the overall ignition time T for all of the CCFLs, and determine whether the time T calculated is over a predetermined threshold time $T_{max}$. For example, the time $T_{max}$ is shown in FIG. 2 in relation to a voltage curve 3 (which will be referred to hereinbelow), to represent a maximum time allowed for ignition of all of the CCFLs. Herein, the voltage curve 3 is shown as a dotted line to demonstrate the possible change of the voltage signal resulting from damage that may occur due to overly long time ignition of the CCFLs. In this embodiment, when the time T is equal to or greater than the predetermined time $T_{max}$, the protection circuit can automatically power off the CCFL driving system 20, in order to prevent such damage being caused thereby. Alternatively, in other situations where a maximum/minimum allowable current or voltage is sensed, the protection circuit can respond to such sensed current or voltage, and shut down the CCFL driving system 20. Thus, the protection circuit can prevent the CCFL driving system 20 from sustaining various possible kinds of circuit damage.

Figure 3:
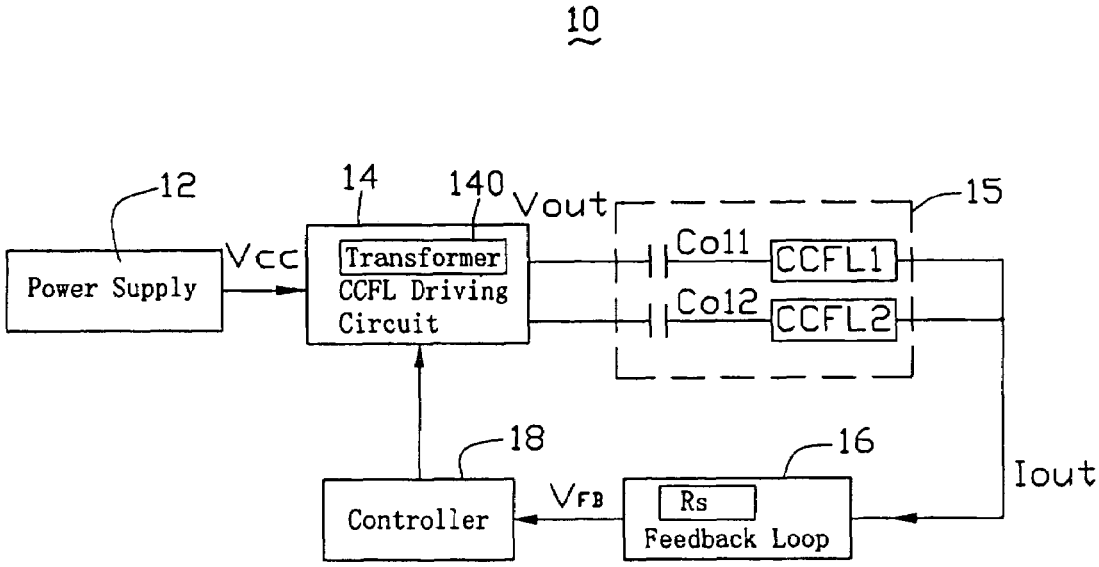
FIG. 3 (PRIOR ART)
FIG. 3 is a circuit diagram of a conventional CCFL driving system.

The controlling circuit 26 can be any suitable circuit configuration for receipt of the feedback voltage $V_{FB}$ (or of a modified voltage) from the feedback circuit 24, and for generating an appropriate modulation signal as an input to the CCFL driving circuit 22. Based on the modulation signal, the CCFL driving circuit 22 regulates the power to be delivered to the CCFL loads, which is described in more detail below. In general, the controlling circuit 26 as shown in FIG. 1 is an exemplary circuit applicable for the generation of such desired modulation signal. FIG. 2 is a voltage diagram with respect to the CCFL circuit 27 of FIG. 1, as well as with respect to the conventional CCFL circuit 15 of FIG. 3. In FIG. 2, part of the voltage curve 2, according to embodiments of the present invention, is shown to represent the output voltage of the CCFL driving circuit 22 to the CCFL circuit 27. In general, the voltage curve 2 has a predetermined number of peaks, each corresponding to a respective predetermined voltage value. The predetermined number of peaks may depend on the number of CCFL loads to be ignited. Each of the predetermined voltages is used to ignite a predetermined one CCFL load, or a predetermined group of CCFL loads. The voltage curve 1 is shown to represent the output voltage of the CCFL driving circuit 14 to the conventional CCFL circuit 15 of FIG. 3. Hereinafter, FIG. 1 and FIG. 2 are considered together.

In the embodiment of FIG. 1, the feedback circuit 24 is coupled to the controlling circuit 26 through a pin 261, so that the voltage from the feedback circuit 24 is fed into the controlling circuit 26. The controlling circuit 26 is also coupled, through a pin 265, to the CCFL driving circuit 22, so that a modulation signal or signals CMP is/are fed into the CCFL driving circuit 22. In the following description, it is assumed that only a single modulation signal CMP is generated. Accordingly, by regulating such modulation signal CMP, the correct power required for delivery to the CCFLs is achieved.

To simplify the illustration of the embodiment in FIG. 1, the controlling circuit 26 herein is divided into two sections, namely "Circuit Block 260" and "Circuit Block 262." Circuit Block 262 represents a circuit for warming up each of the CCFLs to be ignited when these CCFLs are initially powered on. In other words, Circuit Block 262 serves to power up each of the CCFLs from an off state to an operationally-on state. This is referred to as the "warm-up stage" hereinafter. Circuit Block 260, generally structured as one chipset, is connected through the pin 263 and the pin 266 to Circuit Block 262. Circuit Block 260 is utilized to generate an appropriate signal or series of defined signals, namely "the modulation signal(s)" as mentioned above, to the driving circuit 22, and to permit all of the CCFLs to be maintained in an operationally-on state. This is referred to as the "operationally-on stage" herein. Thus, through such circuit configurations as those described in relation to FIG. 1, the CCFL driving system 20 is capable of assuring complete ignition of each of the CCFLs. This is described in detail below.

As shown in FIG. 1, Circuit Block 262 generally includes a capacitor C and a resistor R, with the resistor R being connected to ground. The capacitor C is coupled to the pin 266 of Circuit Block 260. A node (labeled as Vo) between capacitor C and resistor R is coupled to the pin 263. In the present embodiment, a reference voltage of generally 2.5 volts is generated at the pin 266 and input to Circuit Block 262.

Circuit Block 260 can be any suitable circuit configuration for generating an appropriate signal sent to the driving circuit 22 in order to regulate the delivered power to the CCFLs. For example, Circuit Block 260 may be a PWM (Pulse Width Modulation) generator. The PWM generator generates a pulse signal(s) and changes the width of the pulse signal(s) in order to perform such regulation. According to the exemplary embodiment, a first comparator 264 is provided within Circuit Block 260. The first comparator 264 compares the feedback voltage $V_{FB}$ or the voltage $V_o$ from Circuit Block 262 with a reference voltage REF1, and generates the modulation signal CMP according to a difference therebetween, which is described in detail below. The reference voltage REF1 is a predetermined constant reference voltage, which may be the same as or different from the reference voltage REF2, depending on the particular application. For example, the voltage REF1 may be varied according to the allowable voltage or current associated with the operational specifications of a selected number of CCFL loads or a predetermined group of CCFL loads. The operations of the exemplary controlling circuit 26 during the warm-up stage and during the operationally-on stage are discussed in further detail below in connection with FIG. 2.

As stated above, during the warm-up stage, Circuit Block 262 is utilized to enable a selected number of CCFL loads, or all of the CCFL loads to be powered up from an off state to an operationally-on state. For example, when the CCFL driving system 20 is initially powered on, the feedback circuit 24 detects the current $I_{min}$ flowing from the CCFLs and generates a feedback voltage $V_{FB}$ at the pin 261. Simultaneously, due to the charging circuit defined by the capacitor C, Circuit Block 262 generates a voltage $V_o$ at the pin 263. In the exemplary embodiment as shown in FIG. 2, when the voltage $V_o$ exceeds the feedback voltage $V_{FB}$ at the initiation of the warm-up stage, the voltage $V_o$ is employed to effect the CCFL loads to be powered up from an off state to an operationally-on state. The voltage $V_o$ continues to decrease, until the voltage $V_o$ is equal to the feedback voltage $V_{FB}$ and the time $T_0$ as shown in FIG. 2 is reached, due to the charging circuit defined by the capacitor C. In order to assure the complete ignition of each of the plurality of CCFL loads during the warm-up stage, the capacitance of the capacitor C may be varied according to the number of CCFL loads and/or other operational specifications of the circuit configuration. As a result, referring again to FIG. 2, the voltage curve 2, as opposed to the voltage curve 1 of the prior art, is generated. Herein, the time $T_o$ shown in FIG. 2 corresponds to the time at which all of the desired CCFL loads are turned on. The time $T_{max}$ represents the maximum time allowable for ignition of all of the CCFL loads. In other words, if the ignition time needed is in excess of the allowable maximum ignition time $T_{max}$, the protection circuit (not shown) powers off the CCFL driving system 20 in order to prevent any damage occurring due to overly long time ignition.

As stated above, it should be noted that, according to embodiments of the present invention, the warm-up stage is different from the conventional soft start period, such as that disclosed in U.S. Pat. No. 6,502,234. The soft start period (generally corresponding to voltage curve 1 shown in FIG. 1) is typically applicable for certain conventional driving devices, and is generally only directed to a single CCFL load. However, in accordance with embodiments of the present invention, the warm-up stage (corresponding to voltage curve 2) is well suited for all of the CCFL loads, such as four CCFL loads shown in FIG. 1. That is, the warm-up stage serves to effect each of the selected number of CCFL loads being powered from an off state to an operationally-on state.

In addition, the feedback circuit 24 of FIG. 1 is employed to aid in determining when to trigger the transition from the warm-up stage to the operationally-on stage. In the present embodiment, during the warm-up stage, the voltage $V_o$ is greater than the feedback voltage $V_{FB}$, and the second comparator 242 generates a corresponding second control signal, such as a logic state "1". At that time, if there is difference between the sense current $I_{sense}$ and the reference current $I_{REF}$, the voltage $V_o$ is controllably fed into the controlling circuit 26. Through the provision of the reference voltage of 2.5 volts at the pin 266, the fed voltage $V_o$ decreases due to the charging circuit defined by the capacitor C. When the voltage $V_o$ reaches about 1.2 volts, the sense current $I_{sense}$ is equal to the reference current $I_{REF}$. Consequently, the voltage $V_o$ becomes less than the feedback voltage $V_{FB}$, and the second comparator 242 immediately generates another corresponding second control signal, such as a logic state "0," to control the feedback voltage $V_{FB}$ to be fed into the controlling circuit 26. As a result, the warm-up stage is switched to the operationally-on stage. In the operationally-on stage, the first comparator 264 compares the feedback voltage $V_{FB}$ with the reference voltage REF1, and generates the modulation signal CMP to the driving circuit 22 according to the comparison result. Thus, by the modulation signal CMP, the desired amount of power for delivery to the CCFL loads is obtained. In general, Circuit Block 260 includes a pulse or pulse-like signal generator, such as a PWM modulator (not shown). The PWM modulator generates a pulse(s) or pulse-like signal(s) that has its/their pulse width modulated. The pulse or pulse-like signal may be in analog form or digital form depending on the desired application. With the pulse width modulated, such pulse(s) or pulse-like signal(s) is/are typically utilized to regulate the power for delivery to the CCFL loads.

In accordance with the present embodiment, the second comparator 242 is employed to aid in the determination of the transition from the warm-up stage to the operationally-on stage. However, in other embodiments, such determination can be achieved by the direct comparison of the feedback voltage $V_{FB}$ and the voltage $V_o$. That is, during either stage, the greater voltage (either the voltage $V_o$ or the feedback voltage $V_{FB}$) is employed to be fed into the controlling circuit 26, rather than utilizing the second comparator 242 to perform such determination. Furthermore, Circuit Block 262 is not limited to a capacitor circuit as shown in FIG. 1. Circuit Block 262 can be any other suitable circuit configuration for generating the voltage signal of voltage curve 2 (or a like curve) of FIG. 2, in order to assure that all of the CCFL loads are powered from an off state to an operationally-on state. Moreover, Circuit Block 260 and Circuit Block 262 can be integrated into one chipset or formed as a single circuit, for initially generating the voltage signal of voltage curve 2 (or a like curve) during the warm-up stage, and then generating the above-mentioned pulse signal(s) during the operationally-on stage. In addition, the voltage curve 2 (or a like curve) can be generated by any suitable variation or adaptation of Circuit Block 260 and/or Circuit Block 262, or indeed by any other suitable circuit. Further, the CCFL driving system 20 can also be adapted for any suitable situations other than the warm-up stage. For example, during the operationally-on stage, one or more CCFL loads may become powered off, because of, say, the aforementioned unbalanced current between the CCFL loads. Moreover, any suitable variation or adaptation of the CCFL driving circuit 22, the feedback circuit 24, the controlling circuit 26, and the CCFL circuit 27 or combinations thereof may be partly employed to generate the voltage curve 2 (or a like curve). Thus, any conventional or developed circuit configuration for generating the voltage curve 2 (or a like curve), other than the means shown in FIG. 1, may be utilized for carrying out the purposes of the present invention.

It is to be further understood that the above-described embodiments illustrate the scope of the invention but do not restrict the scope of the invention. Variations may be made to the embodiments without departing from the spirit or scope of the invention as claimed herein.

What is claimed is:

1. A cold-cathode fluorescent lamp (CCFL) driving system comprising: a plurality of CCFL loads, a driving circuit, a controlling circuit, and a feedback circuit;

wherein said driving circuit comprises a transformer with a primary winding and a secondary winding; said primary winding coupled to a voltage source; said secondary winding coupled to said plurality of CCFL loads;

each of said CCFL loads is coupled with an impedance for balancing said CCFL loads;

said CCFL loads are parallel connected before being connected to said feedback circuit;

said controlling circuit comprising a first circuit block and a second circuit block coupled to and configured for manipulating said driving circuit, said first circuit block for warming up each of said CCFL loads to be ignited when said CCFL loads are initially powered on, said second circuit block for generating a modulation signal to maintain said CCRL loads to remain at an operationally-on state; and said feedback circuit is coupled to the CCFL loads and the controlling circuit for generating feedback voltage to said controlling circuit;

wherein said first circuit block comprises a capacitor and a resistor connected in series; said capacitor is connected to a reference voltage outputted from said second circuit block, said resistor is connected to ground, a voltage (Vo) generated between said capacitor and said resistor (R) is coupled to said second circuit block.

2. The CCFL driving system as claimed in claim 1, wherein said driving circuit is capable of generating a predetermined voltage to power said plurality of CCFL loads in a warm-up stage and generating a controlled voltage to said plurality of CCFL loads in an operationally-on state.

3. The CCFL driving system as claimed in claim 2, wherein a value of each of said impedances coupled to each of said CCFL loads is adjusted according to said corresponding CCFL loads coupled thereto, so that a current drawn from the secondary winding is evenly divided among said CCFL loads.

4. The CCFL driving system as claimed in claim 2, wherein said feedback circuit comprises a sense circuit and a second comparator, said sense circuit generates said feedback voltage $V_{FB}$ corresponds to a feedback current $I_{sense}$ drawing from said plurality of CCFL loads, said second comparator produces signals for outputting said feedback voltage in correspondence with an ignition status of each of said plurality of CCFL loads according to a difference between said feedback current $I_{sense}$ and a predetermined constant reference current $I_{REF}$.

5. The CCFL driving system as claimed in claim 4, wherein said feedback current $I_{sense}$ flowing from said plurality of CCFL loads corresponds to the overall current drawn from all of the CCFL loads of the CCFL circuit; said predetermined constant reference current $I_{REF}$ is calculated according to the expression $(n-1)/nI_{min}$, wherein "n" represents the total number of the CCFL loads included in the CCFL circuit, which is equal to or greater than 2, and $I_{min}$ represents the minimum current needed to ignite the total number of CCFL loads.

6. The CCFL driving system as claimed in claim 5, wherein if the feedback current $I_{sense}$ is equal to or greater than $(n-1)/nI_{min}$, all of said CCFL loads are complete ignited, said second comparator sends our a control signal to said controlling circuit.

7. The CCFL driving system as claimed in claim 1, wherein said second circuit block comprises a first comparator receiving said voltage Vo, a feedback voltage and a reference voltage; said feedback voltage $V_{FB}$ generated from said feedback circuit; said voltage Vo generated from said first circuit block and a reference voltage REF1; said modulation signal is inputted to said CCFL driving circuit according to the difference between said feedback voltage $V_{FB}$ and said reference voltage REF1.

* * * * *